United States Patent [19]

Seyle

[11] 4,072,040

[45] Feb. 7, 1978

[54] PILE STRAIGHTENER

[75] Inventor: Robert Alan Seyle, Houston, Tex.

[73] Assignee: Bate & Ramey, Inc., Bellaire, Tex.

[21] Appl. No.: 711,841

[22] Filed: Aug. 5, 1976

[51] Int. Cl.[2] ..... B21D 1/06

[52] U.S. Cl. ..... 72/406; 72/475

[58] Field of Search ..... 72/406, 412, 379, 475, 72/705, 455, 380, 457, 453.01, 386, 385

[56] References Cited

U.S. PATENT DOCUMENTS

| | | | |
|---|---|---|---|
| 260,437 | 7/1882 | Wilbur | 72/475 |
| 435,986 | 9/1890 | Tucker | 72/475 |
| 1,429,838 | 9/1922 | Bohle | 72/465 |
| 3,107,559 | 10/1963 | Beche | 72/406 |
| 3,559,439 | 2/1971 | Zak | 72/153 |
| 3,587,286 | 6/1971 | Fritsch | 72/389 |
| 3,911,811 | 10/1975 | Adolfsson | 72/455 |

*Primary Examiner*—C.W. Lanham
*Assistant Examiner*—Gene P. Crosby
*Attorney, Agent, or Firm*—David M. Ostfeld; Murray Robinson; Ned L. Conley

[57] ABSTRACT

A tool for straightening bent steel sheet piles and a method for efficiently operating the tool which has a movable top jig and a stationary bottom jig. The movable top jig has a surface contoured to the normal shape of one face of a pile to be straightened, and the stationary bottom jig has a complementary surface contoured to the normal shape of the other surface of the pile. The top jig is moved in a vertical direction by rams attached to its upper part and in a horizontal direction by rams attached to its side. The method involves vising a pile placed between the complementary surfaces of the jig by alternately activating the vertical and horizontal rams. The top jig is then moved away and the straightened pile is removed.

39 Claims, 6 Drawing Figures

PILE STRAIGHTENER

BACKGROUND OF THE INVENTION

1. The Field of the Invention

The present invention relates to an apparatus and method for straightening bent steel sheet piles. While found to be particularly useful in straightening piles having a "Z" cross section, the present invention is applicable to sheet piles of almost any cross section.

2. Description of the Prior Art

Steel sheet piles are hot-rolled metal sections used for shoring up ditches or other excavations while work, such as laying pipe, is being done within the ditch or excavation. When the work is completed, the piles are removed so that they can be used on a different part of the same project or on a subsequent project.

Because these piles are driven vertically into the ground by a pile driver, the piles have a tendency to flatten out at the lower end and bend along a substantial portion of the lower length of the pile. Such flattening out or bending renders the pile essentially worthless for any subsequent use unless the distorted portion is corrected.

Under present practice, the bent piles are repaired by severing the flattened or bent end and replacing it with a good piece cut from a second pile. The good piece is usually attached by welding it to the first pile. The severed piece is then sold as scrap. See U.S. Pat. No. 3,720,068 issued Mar. 13, 1973, to E. R. DeRosa and U.S. Pat. No. 3,796,057 issued Mar. 12, 1974, to J. J. Dougherty for pile splicing techniques.

Pile splicing, however, is inefficient since it often requires several feet of a standard pile to be scrapped after a single use of the pile. This loss can be a significant expense during a major job. Such a loss is eliminated if, instead of scrapping the bent portion of the sheet pile, the sheet pile is reformed to its original shape.

The process of shaping metal by vising a piece of metal between dies is known. See, for example: U.S. Pat. No. 3,753,368 issued Aug. 21, 1973, to Lang; U.S. Pat. No. 3,119,432 issued Jan. 28, 1964, to Rogers; U.S. Pat. No. 3,610,019 issued Oct. 5, 1971, to Denninger; and U.S. Pat. No. 2,579,030 issued Dec. 18, 1951, to Brauchler. Lang, Rogers and Brauchler teach forcing a movable die against a stationary die upon which the piece to be formed is resting. Lang, for example, shows the use of such dies for reforming bent bumpers to their original shape by forcing a movable die against a stationary die with a "pressing machine."

The prior art, however, teaches a movable die activated by a force applicator moving in only one direction. Because a sheet pile is commonly bent in several planes, some of which may be perpendicular to one another, a force applicator moving in only one direction is insufficient. Furthermore, the molds and dies taught by the prior art are susceptible only to use of a force applicator moving in a single direction. Also the technique shown by Lang requires placing the bent piece over or in the cavity of the female die member. (See FIG. 6 of the Drawings in Lang). It is possible for a pile to be bent so badly when driven into the ground that it could not fit over such a cavity without some initial bending.

SUMMARY OF THE INVENTION

The present invention, using a highly effective apparatus and method for restoring a bent sheet pile to its original shape, eliminates the waste caused by scrapping bent portions of steel sheet piles by straightening the piles while accounting for the unique characteristics of steel sheet piles. The apparatus is a vise having an open-faced, stationary jaw on which a bent pile is placed and an open-faced second jaw movable in two substantially perpendicular directions. The second jaw is movable through the action of two sets of rams. The faces of each of the jaws are contoured to the normal shape of the pile such that as the movable jaw is moved toward the stationary jaw, a pile placed between the jaws is straightened to its normal shape.

BRIEF DESCRIPTION OF THE DRAWINGS

For a further understanding of the nature and objects of the present invention, reference should be made to the following detailed description, taken in conjunction with the accompanying drawings, in which like parts are given like reference numerals and wherein.

DETAILED DESCRIPTION OF THE PREFERRED EMBODIMENT

Figures 1, 5:
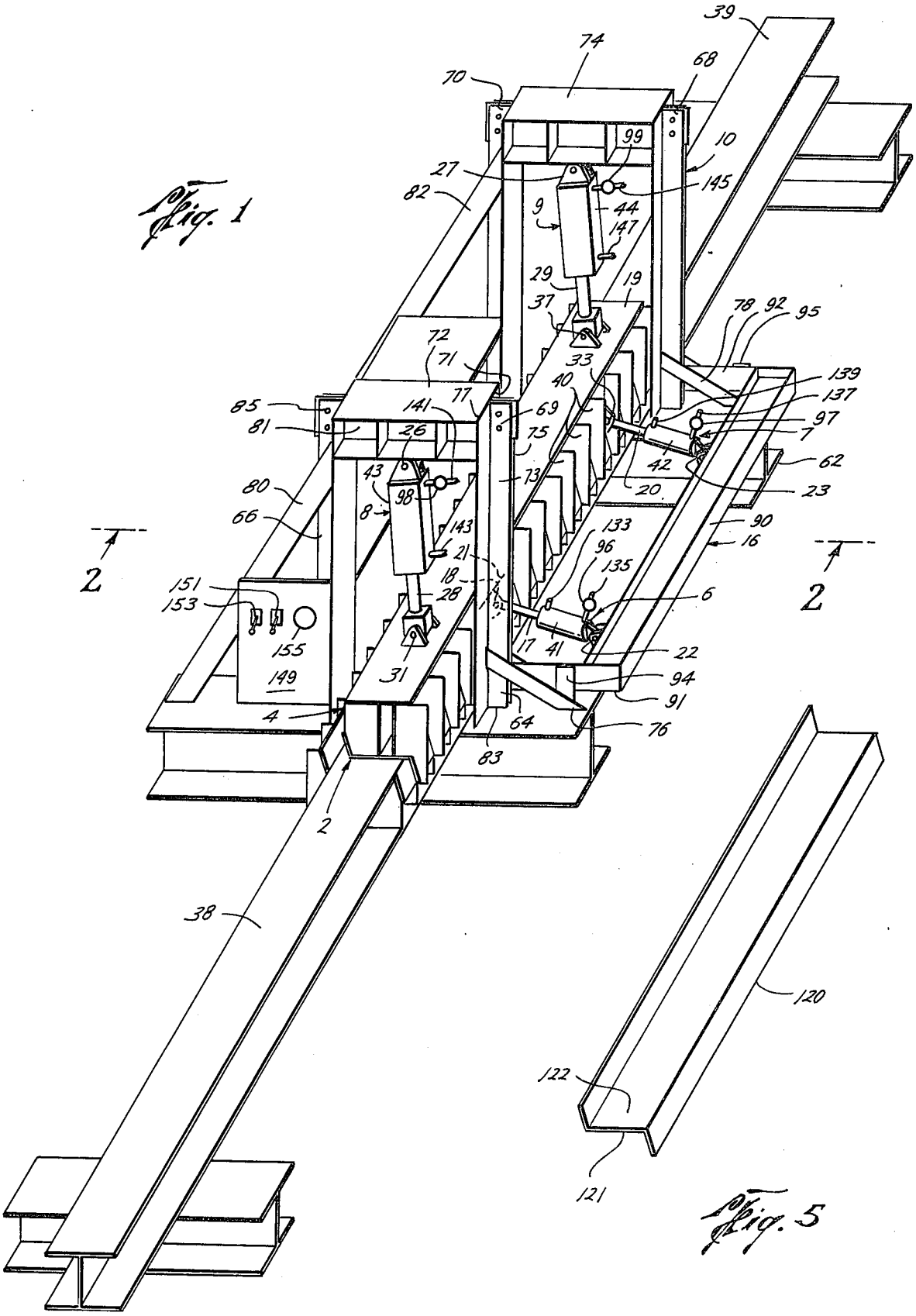
FIG. 1 is an isometric view of the preferred embodiment of the apparatus of the present invention during operation.
FIG. 5 is an isometric view of a z-section pile.

Referring to FIG. 1, the preferred embodiment of the apparatus of the present invention comprises five components: a lower stationary jig 2, an upper movable jig 4, horizontal rams 6 and 7, vertical rams 8 and 9, and a frame 10.

Frame 10 comprises base beams 60, 62 supporting vertical beams 64, 66, 68, 70. Capping beam 72, 74 connect the upper ends of vertical beams 64, 66, 68, 70. Side structure 16 supported between vertical beams 64 and 68 brace horizontal rams 6, 7. Various strengthening trusses support the structure.

Horizontal, wide-flange, base beams 60 and 62 rest on the ground substantially parallel to each other. Vertical beams 64 and 66, substantially parallel to each other, are welded to and rise vertically from base beam 60. Vertical beams 68 and 70, substantially parallel to each other, are welded to and rise vertically from base beam 62. Each of the vertical beams 64, 66, 68 and 70 comprises two angle beams connected together to form a T-shaped cross section having a base and tee. For example, angle beams 69, 71 are connected together to form vertical beam 64, with base 73 and tee 75, 77.

Wide flange capping beam 72 of frame 10 is connected between the tops of vertical beams 64 and 66 with center-portion 81 of beam 72 extending at each end between the two angle beams of verticle beams 64, 66. Capping beam 72 is secured to vertical beams 64, 66 by bolts 85 passing through beams 64, 66 and the extensions of center portion 81. Similarly, capping beam 74 is connected between and secured to vertical beams 68 and 70.

Frame 10 is strengthened by trusses 76, 78, 80 and 82. Each truss comprises two flat beams attached at one end to either side of the base portion of the "T" formed by the angle beams making up the respective vertical beam. Each truss is welded at its other end to its respective base beam. In this manner, truss 76 connects between base 73 of vertical beam 64 and base beam 60; truss 78 connects between the base of vertical beam 68 and base beam 62; truss 80 connects between the base of vertical beam 66 and base beam 60; and truss 82 connects between the base of vertical beam 70 and base beam 62.

Side structure 16 comprises horizontal side support beams 91 and 92, vertical side support beams 94 and 95, and horizontal ram support beam 90. Horizontal side support beam 91 is a flat beam secured at one end between angle beams 69, 71 making up vertical beam 64, and extending horizontally therefrom. Horizontal side support beam 91 is supported by vertical side support beam 94. Vertical side support beam 94 is a flat beam connected by welding or other suitable means at one end to base beam 60 and at the other end to the approximate center of horizontal side support beam 91. It is also clamped between the beams making up truss 76. Horizontal side support beam 92 is a flat beam secured at one end between angle beams making up vertical beam 68, and extending horizontally therefrom. Horizontal side support beam 92 is supported by vertical side support beam 95. Vertical side support beam 95 is a flat beam connected by welding or other suitable means at one end to base beam 62 and at the other end to the approximate center of horizontal side support beam 92. It is also clamped between the angle beams making up truss 78. Horizontal ram support beam 90 is connected between the ends of horizontal side support beams 91 and 92 opposite the ends connected to verticle beams 64 and 68, respectively.

Lower jig 2 (FIGS. 1 and 2) comprises wide flange beam 51 resting on and secured to base beam 60 between vertical beams 64 and 66 and base beam 62 between vertical beams 68 and 70, first lower jig surface portion 53 welded to one edge of upper portion 52 of wide flange beam 51 and held in position by series of ribs 55 and second lower jig surface portion 57 welded to the other edge of upper portion 52 of wide flange beam 51 and held in position by series of ribs 59. Wide flange beam 51 is further reinforced by flat beam 61 extending paralled the center portion of wide flange beam 51.

Upper portion 52 of wide flange beam 51, first lower jig surface portion 53 and second lower jig surface portion 57 together form lower jig surface 34 which, as shown in FIGS. 1 through 4, is contoured to surfaces 121 and 122 of z-section pile 120 of FIG. 5.

An end of each of wide flange support beams 38 and 39 is welded to either end of lower jig 2 and extends horizontally therefrom in the same orientation as lower jig 2.

Upper jig 4 (FIGS. 1 and 2) comprises wide flange beam 43, first upper jig surface portion 45 welded to one edge of lower portion 47 of wide flange beam 43 and held in position by series of ribs 48, and second upper jig surface portion 49 welded to the other edge of lower portion 47 of wide flange beam 43 and held in position by series of ribs 40. Wide flange beam 43 is further reinforced by flat beam 63 extending parallel to the center portion of wide flange beam 43. Upper jig 4 further comprises plate 21 vertically disposed near one end of upper jig 4 between two of the ribs 40, and plate 19 vertically disposed near the other end of upper jig 4 between two other of the ribs 40.

Lower portion 47 of wide flange beam 43, first upper jig surface portion 45 and second upper jig surface portion 49 together form upper jig surface 32 which, as shown in FIGs. 1 through 4, is contoured to surfaces 121 and 122 of z-section pile 120 of FIG. 5.

Upper jig 4 is suspended above lower jig 2 by vertical ram 8 hingedly connected between plate 30 and capping beam 72 by pins 31 and 26, respectively, and by vertical ram 9 hingedly connected between plate 30 and capping beam 74 by pins 37 and 27, respectively. Upper jig 4 is connected to side beam structure 16 through horizontal ram 6 which is hingedly connected between horizontal ram support beam 90 and plate 21 by pins 22 and 18, respectively, and through horizontal ram 7 which is hingedly connected between horizontal ram support beam 90 and plate 33 by pins 23 and 19, respectively.

Rams 8 and 9 include shafts 28 and 29, respectively, extending and retracting from vertical ram cylinders 44 and 46. Rams 6, 7 include shafts 17 and 20, respectively, extending and retracting from horizontal ram cylinders 40 and 42.

In the preferred embodiment, vertical rams 8 and 9, horizontal rams 6 and 7, lower jig 2 and upper jig 4 are situated within frame 10 such that as shafts 28, 29, 17 and 20 extend, upper jig surface 32 meshes with and is vised against lower jig surface 34. For greatest efficiency, arrangement of vertical rams 8 and 9 and horizontal rams 6 and 7 should be in such a manner that when the jigs are in the closed position with a straightened sheet pile disposed between upper jig surface 32 and lower jig surface 34 (FIG. 4), the axes of vertical rams 8 and 9 are vertical and the axes of horizontal rams 6 and 7 are horizontal. This arrangement assures application of maximum force in both directions when the apparatus is in the closed position.

In the preferred embodiment, all rams are hydraulically activated by hydraulic compressors. Horizontal ram 6 is activated through control lines connected to input tubes 133 and 135, horizontal ram 7 is activated through control lines connected to input tubes 137 and 139, vertical ram 8 is activated through control lines connected to input tubes 141 and 143, and vertical ram 9 is activated through control lines connected to input tubes 145 and 147. All control lines are connected between their respective ram and compressor through control panel 149. Control panel 149 comprises levers 151 and 153 and pressure meter 155. Lever 151 selects between activation of either vertical rams 8 and 9 or horizontal rams 6 and 7. Lever 153 selects between either extending or retracting the shafts of the rams activated by virtue of the position of lever 151. Meter 155 indicates the force being applied by the rams so activated.

Rams 6, 7, 8 and 9 are outfitted with ram flow controls 96, 97, 98, and 99, respectively, for adjusting the actual flow rate of hydraulic fluid to the ram so that essentially equal fluid flow rate is introduced to both of the horizontal rams or to both of the vertical rams during activation.

In the preferred embodiment, horizontal rams 6 and 7 and vertical rams 8 and 9 have a six-inch stroke. Horizontal rams 6 and 7 have essentially identical force capacities of about 50 tons each, while vertical rams 8 and 9 have essentially identical force capacities of about 150 tons each. Vertical rams 8 and 9 have greater capacity than horizontal rams 6 and 7 because, for Z-section piles, the greater extent of straightening is accomplished by pressure perpendicular to the center portion of the pile. It should be recognized, however, that for some sheet pile cross-sections or jig arrangements, the greater extent of straightening must be accomplished by horizontal pressure, requiring the horizontal force means to have greater force capacity than the vertical force means. High force capacity in both directions may also be implemented to permit greater versatility of the apparatus. The actual force capability and angle of force means 6, 7, 8 and 9 may vary, but should be sufficient to straighten the sheet piles concerned. The capacities stated for the preferred embodiment are sufficient for most jobs.

In the preferred embodiment, two rams per force direction have been shown. This arrangement is most efficient in preventing torque problems that would be caused by using a single ram in each direction.

Upper jig surface 32 and lower jig surface 34 should be made of a sturdy material, such as a heavy gauge steel, capable of shaping sheet piles without being deformed.

The lengths of jig 2 and jig 4 should be sufficient to allow a substantial length of the bent portion of the sheet pile 120 needing straightening to be disposed between upper jig surface 32 and lower jig surface 34. In the preferred embodiment, the length over which clamping surfaces 32 and 34 mesh is about ten feet. Because piles generally bend over a varying length up to about eight to ten feet, the ten foot long region enables an entire distorted portion of pile 120 to be straightened in one operation. The region between upper jig surface 32 and lower jig surface 34 may be longer to allow for straightening of longer bent regions in a single step, or shorter to allow for less weight and greater portability of the apparatus. Also, in the preferred embodiment, wide-flange beams 38, 39 are provided on either side of lower jig surface 34 far enough to support the entire length of a standard sheet pile 120.

While frame 10 illustrated in FIG. 1 shows the preferred embodiment, the frame of the present invention can assume many variations as long as it has sufficient strength to withstand the extreme pressure exerted by the force means during operation of the apparatus and to maintain the force means and jigs in their proper positions. Operation of the preferred embodiment requires that ram flow controls be adjusted so that horizontal rams 6 and 7 operate in precise unison and vertical rams 8 and 9 operate in precise unison.

While the axes of horizontal rams 6 and 7 are substantially horizontal and the axes of vertical rams 8 and 9 are substantially vertical in the closed position, the actual angle of all of such axes respective to the ground vaires according to the extension of shafts 17, 20, 28 and 29. Thus, when shafts 17 and 20 retract and extend, top jig 4 moves from side to side and the axes of vertical rams 8 and 9 rotate about pins 26 and 27, respectively. When shafts 28 and 29 retract and extend, top jig 4 moves up and dow and the axes of horizontal rams 6 and 7, rotate about pins 18 and 19, respectively.

During operation, upper jig 4 is seperated from lower jig 2 by retracting shafts 28 and 29 which lifts upper jig 4 vertically from lower jig surface 34 while horizontal rams 6 and 7 rotate about pins 18 and 19, respectively; and by then retracting shafts 17 and 20 which moves upper jig 4 to one side. When the apparatus is open, space 100 is left between clamping surfaces 32 and 34. (FIGS. 1 and 2) The sequence of shaft movement may, of course, be varied, as the operator chooses.

Figure 2:
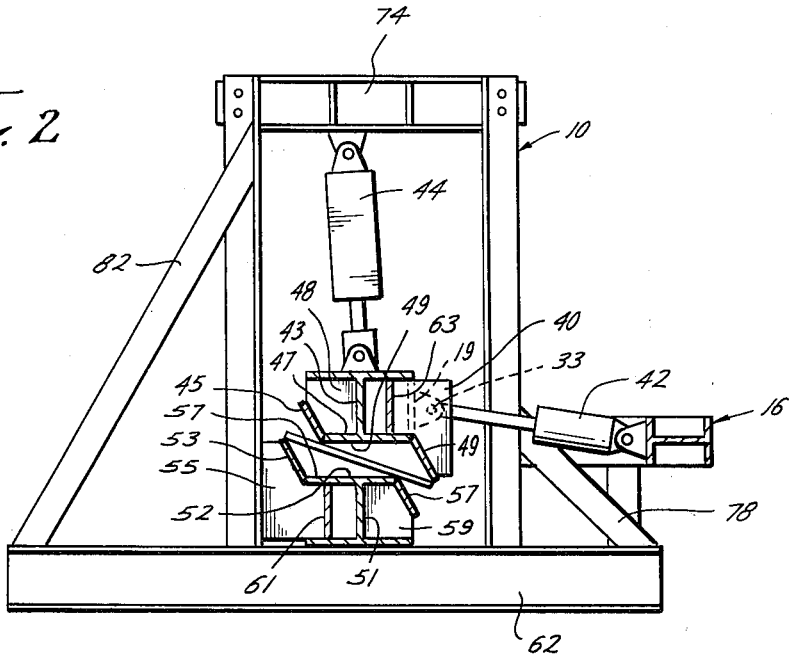
FIG. 2 is a section taken at 2—2 of FIG. 1 showing a bent pile in place.

As seen in FIG. 2, bent pile 102 is then slid along the length of lower jig 2 until the part of pile 102 desired to be straightened is positioned on lower jig 2 in space 100.

Figure 3:
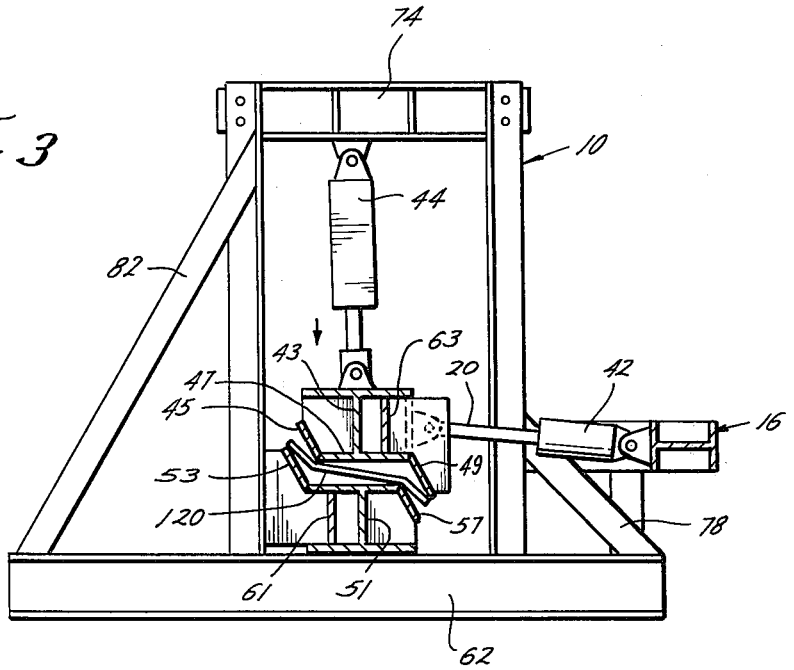
FIG. 3 is a section taken at 2—2 of FIG. 1 showing the bent pile secured in place by vertical movement of the upper jig.
Figure 3A:
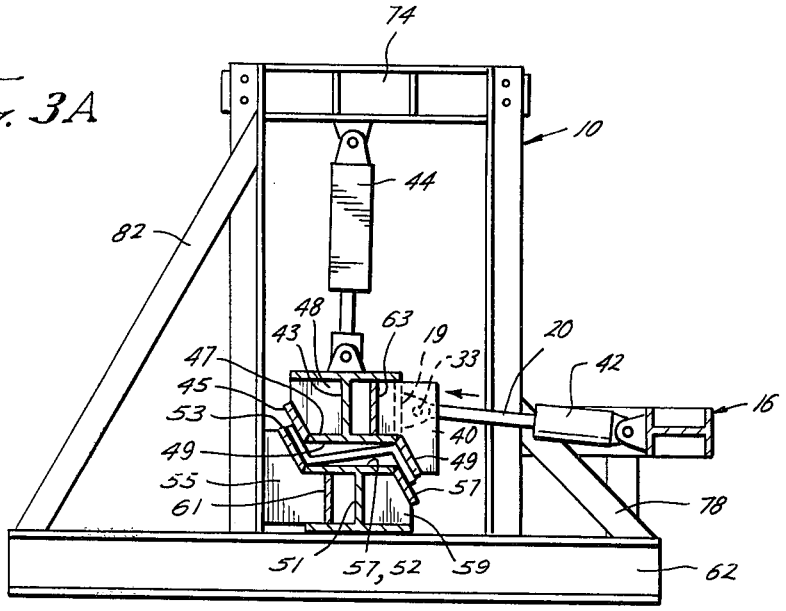
FIG. 3A is a section taken at 2—2 of FIG. 1 showing the bent pile after full application of horizontal force.
Figure 4:
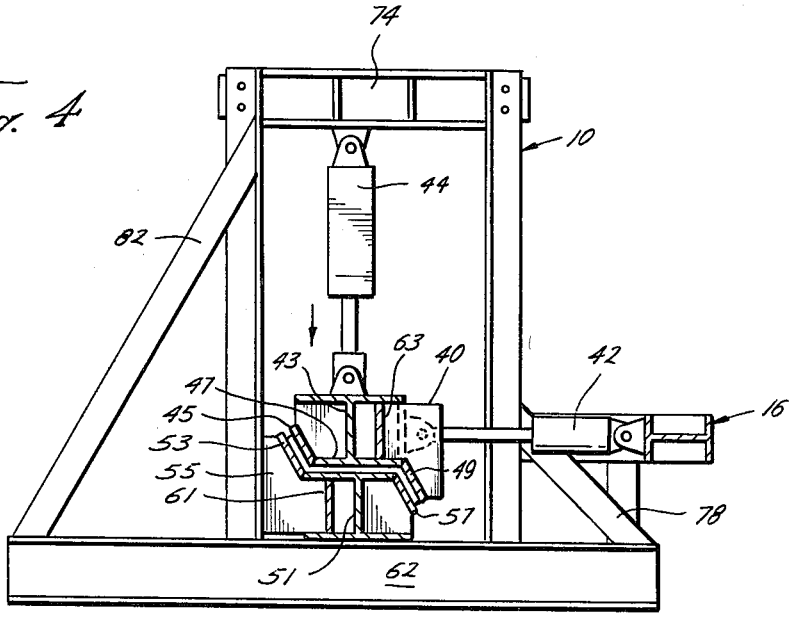
FIG. 4 is a section taken at 2—2 of FIG. 1 showing completion of the straightening operation.

Shafts 28 and 29 are then extended causing upper jig surface 32 to contact bent pile 102. (FIG. 3) When contact is sufficient to hold bent pile 102 in place between upper jig 4 and lower jig 2, extension of shafts 28 and 29 is stopped. Shafts 17 and 20 are then extended (FIG. 3A) until rams 8 and 9 are operating at full force capability, partially vising bent pile 102 between upper jig surface 32 and lower jig surface 34 and substantially straightening the vertical side portions of the z-section pile. Shafts 28 and 29 are then extended until vertical rams 6 and 7 are operating at full force capability. (See FIG. 4)

At this point, the straightening process is complete. The straightened pile may be removed by opening the apparatus as discussed supra and sliding the pile 102 out along the lower jig 2. The apparatus is then ready for straightening a second bent pile.

The method of operation described is a method for straightening when the greatest extent of straightening is to be accomplished by vertical pressure. If the greatest extent of straightening is to be accomplished by horizontal pressure, vertical force by way of extension of shafts 28 and 29 could be applied first to secure the bent pile in place. Shafts 19 and 20 may then be used for primary vising of the bent pile.

Although the preferred embodiment and preferred method of operation as described in detail have been found to be the most satisfactory, many variations in structure and method are possible. For example, the vising pressures may be in any sequence. Such variations merely exemplify the many changes and variations possible.

Because many varying and different embodiments may be made within the scope of the inventive concept taught herein and because many modifications may be made in the embodiment herein detailed in accordance with the descriptive requirements of the law, it should be understood that the details herein are to be interpreted as illustrative and not in a limiting sense.

I claim:

1. An apparatus for straightening bends in sheet pile at ambient temperature, such sheet pile used for shoring in excavations, for reuse for shoring in excavations, comprising:

a frame;

jig means mounted on said frame for straightening such bent sheet pile, said jig means including a moveable portion; and means mounted on said frame and connected to said jig means for moving said portion of said jig means in two nonparallel directions.

2. An apparatus for straightening a structurally distorted sheet pile having a front surface and a rear surface, such sheet pile used for shoring in excavation work, so that such sheet pile may be reused in excavation work, comprising:

a frame;

a first jig mounted on said frame having a first jig surface;

a second jig mounted on said frame having a second jig surface;

said first jig surface contoured to mesh with such front surface of such distorted sheet pile;

said second jig surface contoured to mesh with such rear surface of such distorted sheet pile; and force means for engaging and disengaging said jig surfaces by moving said surfaces relative to each other in at least two nonparallel directions.

3. An apparatus according to claim 2 wherein said first jig is positioned above said second jig.

4. An apparatus according to claim 2 wherein said first jig surface meshes with said second jig surface.

5. An apparatus for straightening a structurally distorted sheet pile having a front surface and a rear surface, comprising:

a frame;

a first jig mounted on said frame having a first jig surface;

a second jig mounted on said frame having a second jig surface;

said first jig surface contoured to mesh with such front surface of such pile;

said second jig surface contoured to mesh with such rear surface of such pile; and force means for engaging and disengaging said jig surfaces by moving said surfaces relative to each other in at least two directions; wherein said directions include a horizontal direction and a vertical direction.

6. An apparatus for straightening a bent steel sheet pile comprising:

a frame;

a first jig and a second jig mounted on said frame;

said jigs having means for vising a substantial portion of the entire width of such sheet pile over at least a portion of the length of such sheet pile;

first force means for engaging and separating said first and second jigs in a first direction; and second force means for engaging and separating said first and second jigs in a second direction.

7. An apparatus according to claim 6 and further including a control panel for controlling the movement of said first force means and said second force means having a first lever for selecting movement of either said first force means or second force means whereby said first and second jigs can be separated in only a vertical direction or a horizontal direction at any one time, a second lever for selecting either engagement or separation in the direction of movement selected by said first lever, and meter means for determining the amount of force applied by the force means selected by said first lever.

8. An apparatus according to claim 6 wherein said second force means and said first force means each includes a plurality of hydraulic rams and a flow control for adjusting the movement of the corresponding rams.

9. An apparatus according to claim 6 wherein such pile has a Z-cross section and said first jig has a first jig surface contoured to the normal shape of a surface of such pile and said second jig has a second jig surface contoured to the shape of a surface of such pile.

10. An apparatus according to claim 6 wherein there is further included a first support beam attached to said first jig at one end of said first jig and a second support beam attached to said first jig at the other end of said first jig, said first and second support beams extending away from said first jig in the axial direction assumed by said first jig.

11. An apparatus according to claim 6 wherein said first jig and said second jig are reinforced by backing structures, each said backing structure including a series of ribs extending substantially the entire length of said jig.

12. An apparatus according to claim 6 wherein said frame includes:

a first and a second base beam being substantially horizontal and substantially parallel to one another and substantially normal to said first and second jigs;

a first and a second vertical beam, each of said vertical beams being attached at one end to the opposite ends of the upper surface of said first base beam and extending substantially vertically therefrom;

a third and a fourth vertical beam, each of said vertical beams being attached at one end to the opposite ends of the upper surface of said second base beam and extending substantially vertically therefrom;

a first capping beam extending between and connecting to said first and said second vertical beams and disposed above and substantially parallel to said first base beam;

a second capping beam extending between and connecting to said third and said fourth vertical beams and disposed above and substantially parallel to said second base beam; and a side beam structure extending between said first and third vertical beams in a direction substantially normal to said base beams;

said side beam structure being disposed above said first and second base beams and disposed below said first and said second capping beams.

13. An apparatus according to claim 6 wherein said first direction is horizontal and said second direction is vertical.

14. An apparatus according to claim 13 wherein said first jig is stationary with respect to the frame and said second jig is horizontally and vertically movable with respect to said first jig.

15. An apparatus according to claim 14 wherein said first force means includes an hydraulic ram horizontally mounted on said frame and having horizontal piston means for moving said second jig in a horizontal direction; and said second force means includes an hydraulic ram vertically mounted on said frame and having vertical piston means for moving said second jig in a vertical direction.

16. An apparatus according to claim 15 wherein said horizontal piston means and said vertical piston means are hingedly connected to said second jig.

17. An apparatus according to claim 16 wherein said hydraulic ram is hingedly connected to said frame.

18. An apparatus according to claim 14 wherein said second jig comprises a second jig surface and a backing means for reinforcing and stabilizing said second jig surface.

19. An apparatus according to claim 18 wherein said first force means and said second force means are connected to said backing means of said second jig.

20. An apparatus according to claim 19 wherein said first force means and said second force means are hingedly connected to said backing means of said second jig.

21. An apparatus according to claim 12 wherein said horizontal force means includes a first and a second horizontal ram, said first and said second horizontal rams being connected at one end to said side beam structure and at the other end to said second jig;

said vertical force means includes a first and a second vertical ram, said first vertical rams being connected between said first capping beam and said first jig, and said second vertical ram being connected between said second capping beam and said first jig;

said first jig resting on said first and said second base beams and extending at one end between said first and said second vertical beams and at the other end between said third and said fourth vertical beams.

22. An apparatus according to claim 12 wherein there is further included a first truss extending diagonally between said first vertical beam and said first base beam, a second truss extending diagonally between said second vertical beam and said first base beam, a third truss extending diagonally between said third vertical beam and said second base beam, and a fourth truss extending diagonally between said fourth vertical beam and said second base beam.

23. An apparatus according to claim 22 wherein each of said vertical beams includes two right-angle beams connected together to form a T-cross section.

24. An apparatus according to claim 23 wherein each said truss includes two flat beams connected to the corresponding vertical beam on either side of the base portion of the T formed by said right-angle beams.

25. An apparatus according to claim 12 wherein said side beam structure includes a first and a second horizontal side support beam connected at one end to said first and said third vertical beams respectively and extending horizontally therefrom and substantially parallel to said first and said second base beams, and a ram support beam extending substantially horizontally between the other ends said first and said second horizontal side support beams.

26. An apparatus according to claim 25 wherein there is further included a first and a second vertical side support beam, said first and said second horizontal side support beams being supported at their respective approximate centers by said vertical side support beams respectively, and said first vertical side support beam extending substantially vertically from said first base beam, and said second vertical side support beam extending substantially vertically from said second base beam.

27. An apparatus for straightening a bent sheet pile having a distorted upper and lower surface, comprising:

a frame;

a first jig fixedly attached to said frame having a first surface adapted to mate with a sugstantially undistorted lower surface of such pile;

a second jig having a second surface adapted to mate with a substantially undistorted upper surface of such pile;

vertical force means, having first means for attaching said vertical force means to said frame and second means for attaching said vertical force means to said second jig for applying vertical force to force mating of said second surface with such upper surface by bending such pile;

horizontal force means, having third means for attaching said horizontal force means to said frame and fourth means for attaching said horizontal force means to said second jig for applying horizontal force to force mating of said second surface with such upper surface by bending such pile;

28. An apparatus according to claim 27 wherein each of said force means include hydraulic rams.

29. An apparatus for straightening a bent sheet pile, comprising:

a first jig having a first jig surface;

a frame having a first top beam, a second top beam, and a side beam and means for supporting said beams, said top beams being parallel to one another and normal to the vertical plane through said side beam; vertical force means for moving said first jig, said first vertical force means being hingedly connected to said first and second top beams;

horizontal force means for moving said first jig, said horizontal force means being hingedly connected to said side beam; a second jig securely attached to said frame, said second jig having a second jig surface adapted to mesh with said first jig surface;

said first jig having hinge means for attaching to said horizontal force means and said vertical force means such that said horizontal and vertical force means mesh said first jig surface and said second jig surface.

30. A method of straightening a bent steel sheet pile at ambient temperatures, so that the straightened sheet pile may be used in excavation work, comprising the steps of:

placing the bent steel sheet pile at ambient temperature between a first jig and a second jig at ambient temperature;

moving said first jig toward said second jig with two degrees of freedom in direction;

compressing the bent sheet pile between the jigs until the bent sheet pile conforms to the vising surfaces of the jigs.

31. A method for straightening a bent steel sheet pile comprising the steps of placing such sheet pile between a first jig and a second jig;

moving the first jig toward the second jig in a first direction until the pile is secured between the first and second jigs;

compressing the pile between the first jig and the second jig in a second direction;

compressing the pile between the first jig and the second jig in said first direction.

32. A method according to claim 31 wherein said first direction and said second direction are normal to one another.

33. A method according to claim 32 wherein said first direction is vertical and said second direction is horizontal.

34. A method according to claim 31 wherein placement of said sheet pile between said first and second jigs includes resting said sheet pile on said second jig.

35. A method according to claim 31 further comprising the step of moving the first jig away from the second jig alternately in said first direction and said second direction.

36. A method for straightening a bent steel sheet pile comprising the steps of:

resting the sheet pile on a stationary jig having a surface contoured to the normal shape of the lower surface of the sheet pile;

resting a movable jig having a surface contoured to the normal shape of the upper surface of the sheet pile on the upper surface of the sheet pile facing away from the stationary jig;

applying a force against the movable jig in a first direction until the pile is vised between the movable jig surface and the stationary jig surface;

applying a force in a second direction further vising said sheet pile between said movable jig surface and said stationary jig surface.

37. A method according to claim 36 wherein said first direction and said second direction are normal to one another.

38. A method according to claim 37 wherein said first direction is vertical and said second direction is horizontal.

39. A method of straightening bent steel sheet pile for reuse in shoring operations for excavation work, comprising the steps of:

placing such bent sheet pile between a first jig and a second jig having complimentary vising surfaces having substantially horizontal portions and substantially vertical portions;

compressing the pile between the surfaces by alternately supplying substantial increases in horizontal and vertical compressive force until the pile conforms to the surfaces;

releasing the straightened sheet pile from between the first jig and the second jig.

* * * * *